US005328387A

United States Patent [19]

Hoffman

[11] Patent Number: 5,328,387

[45] Date of Patent: Jul. 12, 1994

[54] LOCKABLE COVER FOR ELECTRICAL CONNECTOR

[75] Inventor: Ernest G. Hoffman, Middlefield, Conn.

[73] Assignee: Hubbell Incorporated, Orange, Conn.

[21] Appl. No.: 144,586

[22] Filed: Nov. 1, 1993

Related U.S. Application Data

[63] Continuation of Ser. No. 11,731, Feb. 1, 1993, abandoned.

[51] Int. Cl.[5] ..... H01R 13/502

[52] U.S. Cl. ..... 439/469; 439/321; 439/695

[58] Field of Search ..... 439/318, 321, 333, 462, 439/469, 690, 695, 697

[56] References Cited

U.S. PATENT DOCUMENTS

| | | | |
|---|---|---|---|
| 2,396,901 | 3/1946 | Tiffany | 439/140 |
| 2,684,860 | 7/1954 | Rafferty | 285/85 |
| 3,393,395 | 7/1968 | Hubbell | 439/333 |
| 3,437,980 | 4/1969 | Smith | 439/469 |
| 3,500,291 | 3/1970 | Hubbell et al. | 439/333 |
| 3,784,961 | 1/1974 | Gartland, Jr. | 439/465 |
| 3,865,461 | 2/1975 | Ludwig | 439/463 |
| 3,945,702 | 3/1976 | Poliak et al. | 439/337 |
| 4,213,667 | 7/1980 | Wittes | 439/469 |
| 4,291,933 | 9/1981 | Kakaris | 439/321 |
| 4,354,723 | 10/1982 | Lee | 439/321 |
| 4,703,988 | 11/1987 | Raux et al. | 439/321 |
| 4,772,215 | 9/1988 | Falk | 439/333 |
| 5,021,006 | 6/1991 | Fargeaud et al. | 439/469 |
| 5,046,961 | 9/1991 | Hoffman | 439/141 |
| 5,108,297 | 4/1992 | Hoffman et al. | 439/134 |

FOREIGN PATENT DOCUMENTS

| | | | |
|---|---|---|---|
| 1534566 | 7/1990 | U.S.S.R. | 439/318 |
| 2059185 | 4/1981 | United Kingdom | 439/321 |

*Primary Examiner*—Gary F. Paumen

*Attorney, Agent, or Firm*—Jerry M. Presson; David L. Tarnoff

[57] ABSTRACT

An electrical connector with a cover lockably coupled to a retainer body to prevent inadvertent uncoupling of the cover from the retainer body. The cover and retainer body are locked together by a locking arrangement which includes a locking screw or member, a passageway formed in either the cover or the retainer body for threadedly receiving the locking screw therein, and a recess formed either the cover or the retainer body for receiving the tip of the locking screw therein. In a preferred embodiment, the recess is an arcuate slot with an inclined locking surface which slopes towards the locking screw in the direction of rotation for uncoupling the cover from the retainer body. In another embodiment, the recess is a tubular or cylindrical bore with a pair of locking surfaces.

30 Claims, 3 Drawing Sheets

LOCKABLE COVER FOR ELECTRICAL CONNECTOR

This is a continuation of application Ser. No. 08/011,731 filed on Feb. 1,1993, now abandoned.

Field of the Invention

This invention relates to a cover releasably coupled to a body member with a locking arrangement to prevent inadvertent uncoupling of the cover from the body member. More specifically, the invention relates to screw-on or bayonet type covers for electrical connectors or plugs of the locking type. The locking arrangement includes a screw or fastener extending axially between the cover and the body member into a recess formed in either the cover or the body member.

BACKGROUND OF THE INVENTION

Electrical connector assemblies of the locking type are well known in the connector industry. Normally, the female portion of such a connector assembly has two or more arcuate, circularly arranged slots, while the male portion has an equal number of arcuate blades which are dimensioned and arranged for insertion into the slots of the female portion by a simple axial movement, and then, via a rotation of one or both of the connector portions the blades can be moved into a position from which they can not be separated by simple axial movement. To accomplish this, one or more of the blades usually has an L-shaped configuration in which the laterally extended portion, or flag, of the blade engages a recess or shelf within the slot of the female portion as a result of the rotation.

The male and female portions typically have a retainer body with either blade contacts or female contacts and a cover releasably coupled onto the retainer body by either two or more screws, or threads formed on the cover and retainer body (screw-on), or a bayonet connection. This screw-on or bayonet connection between the retainer body and the cover presents a unique problem when the male and female portions of the electrical connector assembly are coupled together. In particular, the unlocking motion required to unlock a locking type electrical connector assembly requires a counterclockwise rotation of the cover in the same counterclockwise direction used for coupling the threaded or bayonet-mounted cover from the retainer body. Accordingly, the cover of many prior art electrical connectors occasionally will uncouple from the retainer body during the unlocking rotation of the electrical connector assembly.

The most common way to overcome inadvertent loosening or uncoupling is to provide the cover and the retainer body body with a separate locking latch. However, a separate locking latch increases the manufacturing costs and requires a secondary unlocking action by the user. Another way to overcome inadvertent loosening or uncoupling is to select a thread pitch between the cover and retainer body such that the unscrewing torque for uncoupling the cover from the retainer body is substantially above the blade unlocking torque for uncoupling the male portion from the female portion However this introduces other problems such as the tightening torque exerted by an individual can cause the threads between the cover and the retainer body to self lock. In other words, the cover becomes very difficult to unscrew from the retainer body. Accordingly, the threads between the cover and retainer body typically have a very shallow pitch so that the cover can be removed from the retainer body with very little force.

Examples of various locking connectors are disclosed in the following U.S. Pat. Nos. 2,396,901 to Tiffany; 3,393,395 to Hubbell; 3,784,961 to Gartland; 3,945,702 to Poliak et al; 4,213,667 to Wittes; and 5,046,961 to Hoffman.

In view of the above, it is apparent that there exists a need for a lockable cover for an electrical connector of the locking type which will prevent inadvertent uncoupling of the cover from the retainer body. This addresses this need in the art, along with other needs which will become apparent to those skilled in the art once given this disclosure.

SUMMARY OF THE INVENTION

Accordingly, a primary object of the invention is to provide a locking arrangement to lock a screw-on or bayonet type cover to a body member.

Another object of the invention is to provide an electrical connector of the locking type with a locking arrangement which will prevent inadvertent uncoupling of its screw-on or bayonet type cover from its retainer body during the unlocking rotation of the electrical connector from its associated electrical connector.

Another object of the invention is to provide an electrical connector that is relatively simple to manufacture, assemble and use, and that has relatively few number of parts.

The foregoing objects are basically attained by providing an electrical connector, the combination comprising: a retainer body having first and second oppositely facing ends with a longitudinal coupling axis extending therebetween, at least two curved blade contacts extending axially from the first end, and an external thread thereon; a cover having first and second ends with a longitudinal coupling axis extending therebetween, an aperture adapted to receive an electrical cable therethrough for electrical connection to the curved blade contacts, and a longitudinally extending bore with an internal thread thereon threadedly engaged with the external thread on the retainer body via a rotation of the cover relative to the retainer body in a first direction; and a locking arrangement coupled to the retainer body and the cover to extend longitudinally between the second end of the retainer and the cover for resisting rotation of the cover relative to the retainer body in a second direction opposite the first direction.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings which form part of this original disclosure.

DETAILED DESCRIPTION OF THE DRAWINGS

Figure 1:
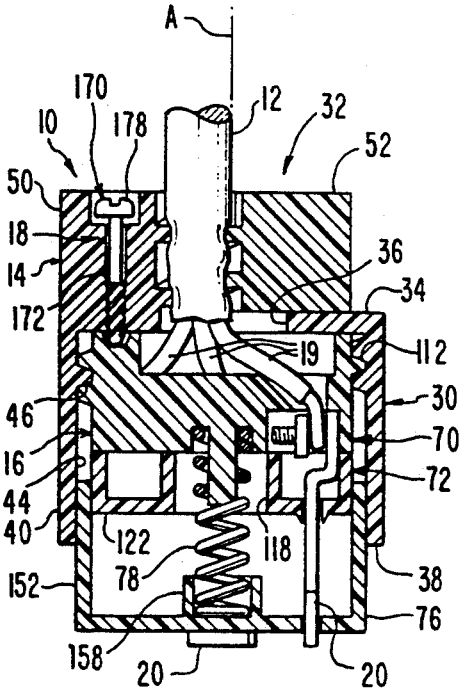
FIG. 1 is a side elevational view in substantially longitudinal cross section of a male electrical connector in accordance with the present invention.

As seen in FIGS. 1-4, a male electrical connector 10 in accordance with a first embodiment of the present invention is illustrated, and includes an electrical cable 12, a cover 14 releasably coupled to an end of cable 12, a plug or retainer body 16, and a locking arrangement 18 for preventing inadvertent uncoupling of cover 14 from retainer body 16.

Locking arrangement 18 applies an axially directed force between cover 14 and retainer body 16 to resist or prevent inadvertent uncoupling of cover 14 from retainer body 16 during the rotation of male electrical connector 10 to unlock it from a female electrical connector.

While a male electrical connector is used to illustrate locking arrangement 18 of the present invention, it will be apparent to those skilled in the art once given this disclosure that locking arrangement 18 can be used with a female electrical connector. Also, it will be apparent to those skilled in the art once given this disclosure that locking arrangement 18 can be used with either a screw-on or a bayonet type connection between cover 14 and retainer body 16.

Cable 12 is preferably a multi-conductor cable having three insulated conductors 19 with exposed ends for electrical connection with blade contacts 20 in a conventional manner as described below.

Figure 3:
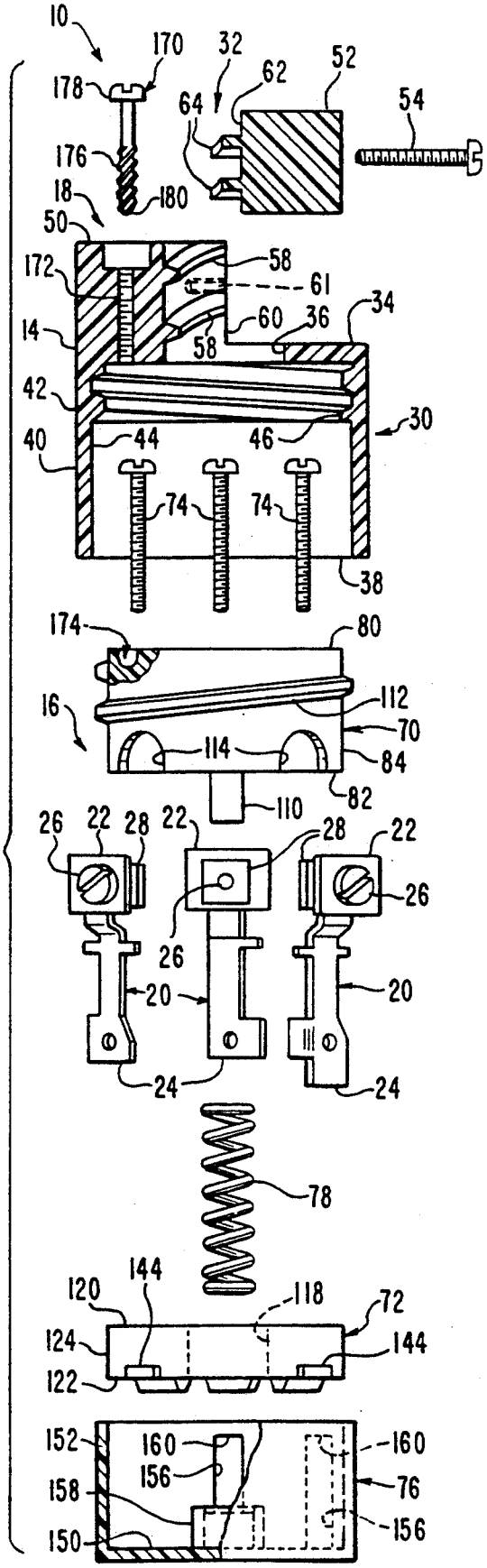
FIG. 3 is an exploded side elevational view of the male electrical connector shown in FIGS. 1-2 with portions of the cover and the retainer body shown in substantially longitudinal cross section.

As seen in FIG. 3, blade contacts 20 are conventional blade contacts formed of a conductive material such as metal, and are slightly curved around their longitudinal axis. Each blade contact 20 has a contact portion 22, and a flag portion 24 extending from contact portion 22 to form a substantially L-shaped elevational configuration.

Contact portion 22 of each blade contact 20 has a suitable threaded hole therethrough for rotatably receiving a screw 26 therein. A slightly curved plate 28 is threaded onto each one of screws 26 by suitable threaded hole formed in each plate 28 for clamping one of the exposed ends of conductors 19 between each plate 28 and each contact portion 22. Specifically, this structure electrically connects conductors 19 of cable 12 to the three blade contacts 20 by having each of the exposed ends of the conductors 19 received between one of the plates 28 and one of the contact portions 22 with plates 28 moving towards contact portions 22 to clamp the exposed ends therebetween upon rotation of screws 26.

Cover 14 has a longitudinal coupling axis A, and includes a tubular, main body portion 30 for receiving retainer body 16 therein, and a clamping portion 32 for releasably coupling an end of cable 12 to cover 14. Preferably, both main body portion 30 and clamping portion 32 are made of a hard, rigid plastic material or any other suitable non-conductive material.

As seen in FIG. 3, main body portion 30 has a first end wall 34 with a centrally located opening 36 for receiving cable 12 therethrough, a second open end 38 longitudinally spaced from first end wall 34, and a substantially cylindrical side wall 40 extending between first end wall 34 and second open end 38 to form a cylindrical longitudinally extending bore for receiving retainer body 16 therein.

Figure 4:
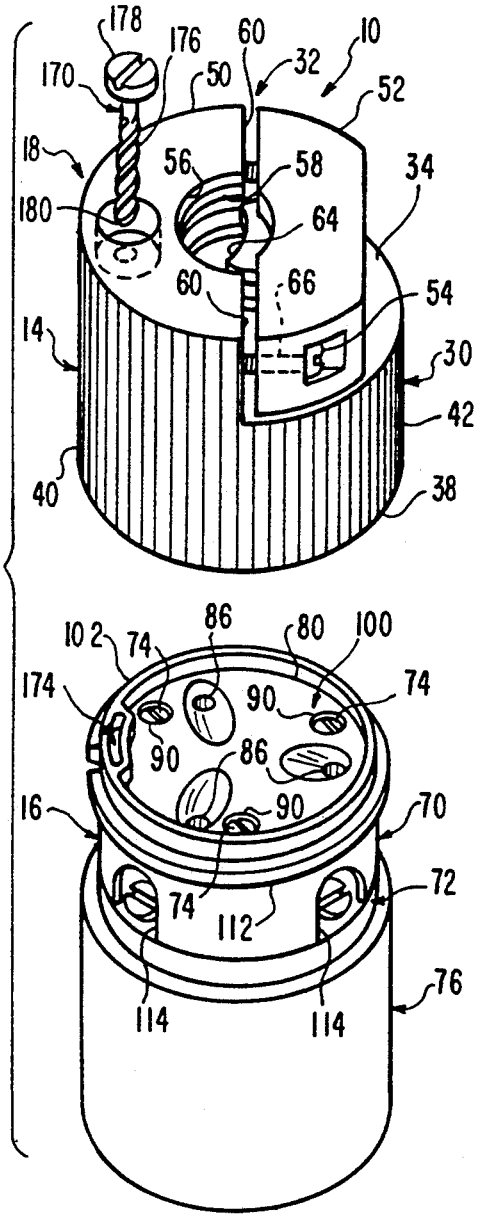
FIG. 4 is a top perspective view of the male electrical connector shown in FIGS. 1-3 with the cover unthreaded from the retainer body.

Side wall 40 is tubular for receiving retainer body 16 therein, and has a textured outer surface 42 and a cylindrical inner surface 44. As seen in FIG. 4, textured outer surface 42 preferably has a plurality of longitudinally extending ridges to improve gripping of cover 12 for rotating connector 10. Inner surface 44 has an internal thread 46 integrally formed thereon for releasably coupling retainer body 16 to cover 14. Internal thread 46 extends along inner surface 44 for about one turn to about one and one-half or two turns.

As seen in FIGS. 3 and 4, clamping portion 32 includes a stationary jaw 50 integrally formed with first end wall 34 of main body portion 30, and a movable jaw 52 movably coupled to stationary jaw 50 by a pair of clamping fasteners or screws 54 (only one shown).

Stationary jaw 50 has a semicircular surface 56 with a pair of inclined ribs 58 integrally formed thereon, and a pair of planar surfaces 60, each being located on an opposite side of semicircular surface 56 and extending perpendicularly from first end wall 34. Semicircular surface 56 is coincident with a portion of the surface forming opening 36 of main body portion 30 for engaging a portion of cable 12.

Each of the planar surfaces 60 has a threaded bore 61 for threadedly receiving clamping screws 54 therein and for movably securing movable jaw 52 to stationary jaw 50. Planar surfaces 60 are substantially perpendicular to first end wall 34 of main body portion 30.

Movable jaw 52 has a clamping surface 62 with a pair of inclined ribs 64 extending outwardly from clamping surface 62. Ribs 64 are inclined in the opposite direction of ribs 56 so that opposing ribs crisscross each other to firmly clamp cable 12 between stationary jaw 50 and movable jaw 52. In particular, as seen in FIG. 4, movable jaw 52 has a pair of holes 66 (only one shown) for receiving screws 54 (only one shown) therethrough. Screws 54 pass through holes 66 of movable jaw 52, and are then threaded into holes 61 of stationary jaw 50.

Retainer body 16 houses three blade contacts 20, and includes a first retainer portion 70, a second retainer portion 72 releasably coupled to first portion 70 by three screws 74, and a shield portion 76 slidably coupled to second portion 72 and maintained in an extended position by compression spring 78 for covering blade contacts 20. Preferably, first retainer portion 70, second retainer portion 72 and shield portion 76 are all constructed of a hard, rigid plastic material or any other suitable non-conductive material.

First retainer portion 70 includes a first surface 80, a second surface 82 longitudinally spaced from first surface 80, a cylindrical side surface 84 extending between first surface 80 and second surface 82, three axially extending bores 86 for receiving conductors 19, therethrough, and three axially extending bores 90 for receiving screws 74 therethrough.

Figure 5:
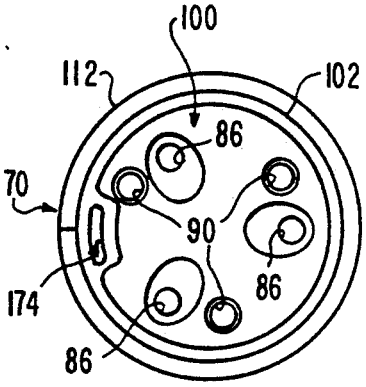
FIG. 5 is a top plan view of the first retainer portion of the retainer body of FIGS. 1-4.

As seen in FIG. 5, first surface 80 of first retainer portion 70 has an outwardly extending, substantially cylindrical wall 102 which forms a substantially cylindrical recess 100. Recess 100 provides sufficient space between the interior surface of end wall 34 of cover 14 and first surface 80 of retainer body 16 when coupled together for splitting electrical conductors 19 into their respective bores 86.

Figure 6:
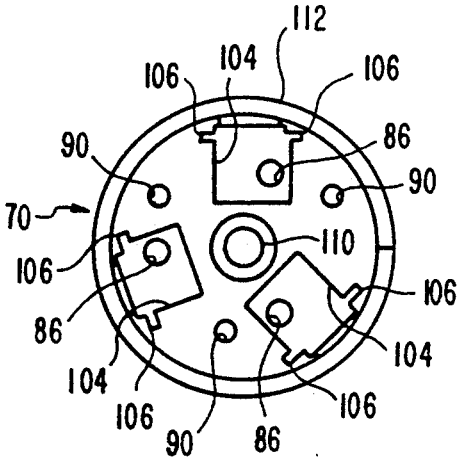
FIG. 6 is a bottom plan view of the first retainer portion of the retainer body of FIGS. 1-5.

As seen in FIG. 6, second surface 82 of first retainer portion 70 includes three circumferentially spaced cavities 104 which communicate with bores 86, a centrally located, cylindrical recess 108, and a centrally located cylindrical rod 110 extending substantially perpendicularly from recess 108 and protruding past second surface 82.

Cavities 104 are substantially rectangular with each cavity having a pair of opposed slots 106 formed at the outside corners of each cavity 104 for receiving and frictionally retaining one of the contact portions 22 therein. Each of the cavities 104 are sized to accommodate one of the contact portions 22 and the associated screw 26 and plate 28 with the exposed end of one of conductors 19 clamped therebetween. Accordingly, each of the conductors 19 is electrically coupled to one of contact portions 22 of blade contacts 20 within one of the cavities 104.

As seen in FIG. 1, one end of spring 78 is received on rod 110 and within recess 108, while the other end of spring 78 abuts against shield portion 76 as discussed below.

Cylindrical side surface 84 of first retainer portion 70 has an external thread 112 integrally formed thereon for threadedly and releasably coupling retainer body 16 to cover 12, and three windows 114 formed therein.

Each of the windows 114 communicate with one of the cavities 104 so that the head of one of the screws 26 of one of the blade contacts 20 faces out of each of the windows 114. This arrangement allows a screwdriver to access and rotate screws 26 through windows 114 for clamping the exposed ends of conductors 19 to contact portions 22.

Figure 7:
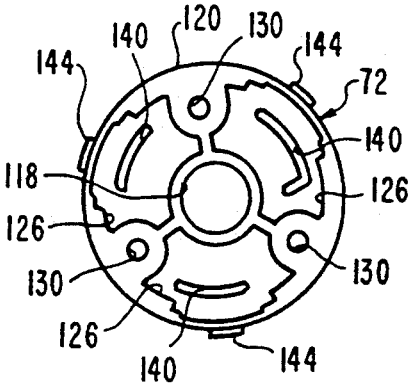
FIG. 7 is a top plan view of the second retainer portion of the retainer body of FIGS. 1-4.
Figure 8:
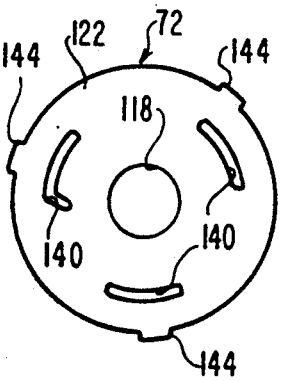
FIG. 8 is a bottom plan view of the second retainer portion of the retainer body of FIGS. 1-4 and 7.

As seen in FIGS. 1, 7 and 8, second retainer portion 72 is substantially disc-shaped with a centrally located throughbore 118 for receiving spring 78 therethrough, and has a first axially facing surface 120, a second axially facing surface 122 facing in the opposite direction of first surface 120, and a cylindrical side surface 124 extending between first and second axially facing surfaces 120 and 122.

As seen in FIG. 7, first surface 120 of second retainer portion 72 has three cavities 126 and three threaded bores 130. Bores 130 threadedly receive screws 74 for releasably coupling first and second retainer portions 70 and 72 of retainer body 16 together. Cavities 126 align with cavities 104 of first retainer portion 70 for receiving a part of contact portions 22 of blade contacts 20 therein.

Three curved slots 140 are formed in and extend through second retainer portion 72 for receiving the flag portion 24 of one of blade contacts 20 therethrough. Slots 140 are equally spaced in the circumferential direction by about 120° with each slot 140 being positioned in one of the cavities 126, respectively.

Side surface 124 of second retainer portion 72 has three detents 144, which are equally spaced in the circumferential direction by about 120°. Detents 144 cooperate with shield portion 76 to provide a snap fit between shield portions 76 and second retainer portion 72, and to permit slidably movement between second retainer portion 72 and shield portion 76.

Figure 9:
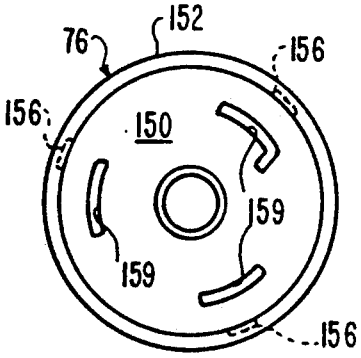
FIG. 9 is a top plan view of the shield portion of the retainer body of FIGS. 1-4.

As seen in FIGS. 3 and 9, shield portion 76 has a substantially disc-shaped planar plate 150 forming the bottom thereof, a tubular, preferably cylindrical, side wall 152 extending upwardly from plate 150, and a cylindrical inner wall 158 extending upwardly from plate 150 for receiving one end of compression spring 78. The longitudinal axes of side wall 152 and inner wall 158 are preferably coincident with the longitudinal coupling axis A of the connector, and plate 150 is substantially perpendicular to axis A. Plate 150 has three curved slots 159 which are substantially equally spaced in the circumferential direction by about 120°. Each of the slots 159 is sized to receive one of the flag portions 24 of one of the blade contacts 20 therethrough.

Shield portion 76 is slidably received on second portion 72 via a snap-fit. In particular, side wall 152 of shield portion 76 has three longitudinally extending slots 156 for slidably receiving detents 144 therein. A ledge 160 is formed in each of the slots 156. Each ledge 160 is spaced longitudinally from plate 150 and positioned adjacent the free end of side wall 152 for retaining and limiting longitudinal movement of shield portion 76 relative to second retainer portion 72 via detents 144 which are received in slots 156.

Figure 2:
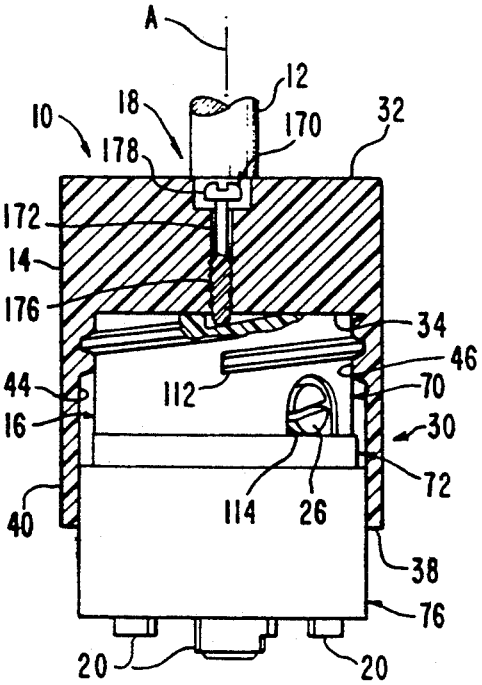
FIG. 2 is a side elevational view of the male electrical connector shown in FIG. 1 with certain parts broken away for clarity and rotated 90° from the position shown in FIG. 1.
Figure 10:
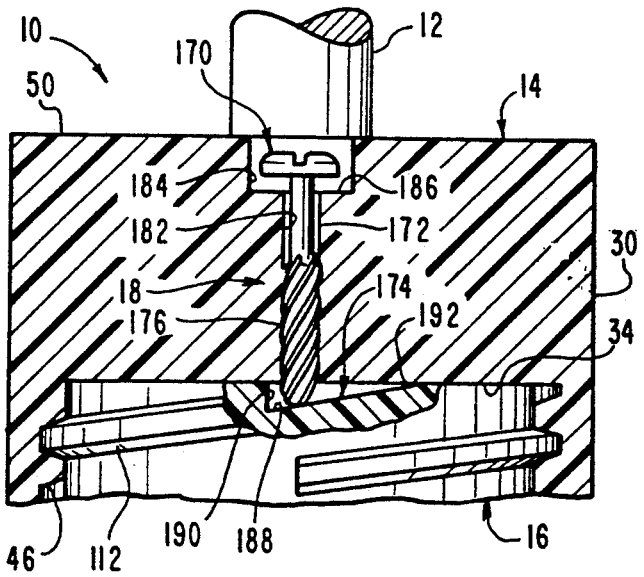
FIG. 10 is enlarged, partial side elevational view of the electrical connector shown in FIGS. 1-9 with certain parts broken away for clarity.

As seen in FIGS. 1, 2 and 10 locking arrangement 18 includes a locking screw or member 170, a passageway or bore 172 extending axially through stationary jaw 50 and through first end 34 of main body portion 30, and an arcuate slot or recess 174 formed in wall 102 of first retainer portion 70 of retainer body 16 for receiving the tip 176 of locking screw 170 therein.

Locking screw 170 extends substantially parallel to longitudinal coupling axis A, and is spaced radially from longitudinal coupling axis A. Locking screw 170 has a threaded shaft 176, a head 178 formed at one end of shaft 176, and a round tip 180 formed at the other end of shaft 176.

Locking screw 170 preferably has a fast lead type thread on shaft 176 which will allow locking screw 170 to seat in arcuate recess 174 in a single revolution. Also, preferably tip 180 of locking screw 170 is rounded to prevent damage to arcuate recess 174, when tip 180 contacts arcuate recess 174.

Passageway 172 includes a first bore 182 for threadedly receiving thread shaft 176 of locking screw 170, a counterbore 184 for receiving head 178 of locking screw 170 therein, and an axially facing surface 186 extending between bores 182 and 184.

First bore 182 may either be preformed with threads or thread during the initial insertion of locking 170 therein. First bore 182 is shorter in length than shaft 176 of locking screw 170 so that head 178 does not contact axially facing surface 186 when tip 180 contacts recess 174.

As seen in FIG. 10, arcuate recess 174 has an inclined locking surface 188 with a first end 190 and a second end 192. Locking surface 188 tapers upwardly towards locking screw 170 from first end 190 to second end 192. In other words, inclined locking surface 188 tapers towards locking screw 170 in the direction of rotation to uncouple cover 14 from retainer body 16. Preferably, inclined locking surface 188 has a slope greater than the slope of threads 46 and 112. Thus, as cover 14 is turned counterclockwise relative to retainer body 16, the locking screw 170 will continue to contact locking surface 188 and the frictional force between threads 46 and 112 will increse the further cover 14 is rotated relative to retainer body 16. This arrangement is advantageous since inclined locking surface 188 will prevent cover 14 from inadvertently uncoupling from retainer body 16, even if locking screw 170 is only partially threaded into passageway 172 and tip 180 is received in recess 174 but does not initially contact locking surface 188.

Assembly and Operation

To assemble electrical connector 10 and to couple it to the end of cable 12, blade contacts 20 are placed in retainer body 16. Specifically each of the contact portions 22 is positioned in one of the cavities 104 of first retainer portion 70 and one of the associated cavities 126 of second retainer portion 72, while each of the flag portions 24 extends through and outwardly from one of the curved slots 140.

Then, screws 74 are inserted through holes 90 of first retainer portion 70 and threaded into bores 130 of second retainer portion 72 for rigidly coupling first and second retainer portions 70 and 72 together.

Next, one end of compression spring 78 is inserted over rod 110 and into recess 108, while the other end of compression spring 78 is inserted into the cylindrical spaced of shield portion 76 which is defined by cylindrical inner wall 158. Thus, one end of spring 78 contacts second retainer portion 72, while the other end of spring 78 contacts plate 150 of shield portion 76 to bias shield portion 76 away from second retainer portion 72. Shield portion 76 is then snap-fitted onto second retainer portion 72 by detents 144 engaging longitudinal slots 156. Each of the detents 144 engages one of the ledges 160 to hold spring 78 partially compressed and to limit outward movement of shield portion 76 from second retainer portion 72. Shield portion 76 substantially covers the flag portions 24 of blade contacts 20 when in its extended position.

Now, the end of cable 12 is inserted through opening 36 of cover 14. The exposed ends of conductors 19 are inserted through bores 86 so that each of the exposed ends contacts one of the contact portions 22 of blade contacts 20. Specifically, each of the exposed ends of conductors 19 is electrically coupled to one of the blade contacts 20 by rotation of screws 26 which clamps the exposed ends between plates 28 and contact portions 22.

Finally, cover 14 is threaded onto retainer body 16 via internal thread 46 and external thread 112 until wall 102 of first retainer portion 70 abuts against the interior surface of first end wall 34, and cable 12 is then clamped to cover 14 by jaws 50 and 52.

Cover 14 can now be locked to retainer body 16 by locking screw 170 for preventing or resisting inadvertent coupling of cover 14 from retainer body 16. In particular, locking screw 170 is threaded into passageway 172 so that tip 180 of locking screw 170 abuts against inclined locking surface 188 of recess 174. Counterclockwise rotation of cover 12 relative to retainer body 16 is thereby prevented or resisted by locking screw 170 engaging arcuate recess 174. Specifically, locking screw 170 applies a jacking force to compress internal thread 46 of cover 14 against external thread 112 of retainer body 16 to create a frictional force at the thread interface between cover 14 and retainer body 16. Also locking screw 170 impinges or abuts against inclined locking surface 188 of recess 174 so that locking screw 170 in cover 14 cannot rotate in a counterclockwise direction.

Thus, even if locking screw 170 is not fully threaded into passageway 172 to initially contact inclined locking surface 188 of recess 174, the cover 14 can only unscrew in the counterclockwise direction until locking screw 170 runs into or hits the ramp of the inclined locking surface 188 of recess 172 to prevent further unscrewing.

Figure 11:
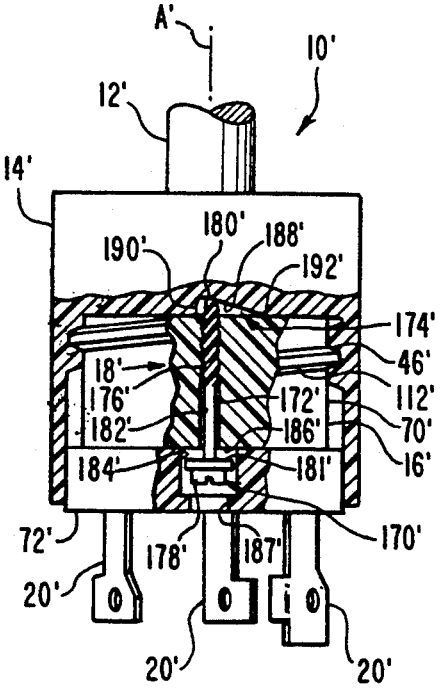
FIG. 11 is a side elevational view of a second embodiment of a male electrical connector in accordance with the present invention with certain parts broken away for clarity.

Electrical Connector of FIG. 11

Referring now to FIG. 11, a male electrical connector 10' in accordance with a second embodiment of the present invention is illustrated, and includes a cable 12', a cover 14' coupled to the end of cable 12', a retainer body 16' threadedly and releasably coupled to cover 14', and a locking arrangement 18' coupled between cover 14' and retainer body 16' for preventing or resisting inadvertent uncoupling of cover 14' from retainer body 16'.

Electrical connector assembly 10' is a slight modified embodiment of the electrical connector 10 of the present invention. Specifically, electrical connector 10' is constructed in a similar fashion to electrical connector 10, except that a modified locking arrangement 18' has been used and the shield portion 76 has been eliminated. Accordingly, cable 12', cover 14', retainer body 16' and blade contacts 20' are substantially identical in construction to cable 12, cover 14, retainer body 16 and blade contacts 20, and thus only the significant differences between them will be discussed and illustrated therein.

In electrical connector 10', locking arrangement 18' includes a locking screw or member 170', a passageway 172' formed in retainer body 16' for threadedly receiving locking screw 170', and an arcuate slot or recess 174' formed in the inside end wall of cover 14' for receiving the tip 180' of locking screw 170'.

Locking screw 170' extends substantially parallel to the longitudinal coupling axis A' of electrical connector 10', and is spaced radially from longitudinal coupling axis A'. Locking screw 170' has a threaded shaft 176', a head 178' formed at one end of shaft 176', and a round tip 180' formed at the other end of shaft 176'.

Locking screw 170' preferably has a fast lead type thread on shaft 176' which will allow locking screw 170' to seat in arcuate recess 174' in a single revolution. Also, preferably tip 180' of locking screw 170' is rounded to prevent damage to arcuate recess 174', when tip 180' contacts arcuate recess 174'. Head 178' has an annular shoulder 181' extending outwardly therefrom and located adjacent shaft 176'.

Passageway 172' includes a first bore 182' extending through first retainer portion 70' for threadedly receiving thread shaft 176' of locking screw 170', an enlarged area or bore 184' formed in second retainer portion 72' for receiving head 178' of locking screw 170' therein, an axially facing surface 186' extending between bores 182' and 184', and an exit aperture or bore 187' formed in second retainer portion 72'. Enlarged area or bore 184' is slightly larger than the diameter of shoulder 181' of head 178', while exit aperture or bore 187' is smaller than the diameter of shoulder 181' but larger than the diameter of the rest of head 178'. Thus, this arrangement prevents connector 10' from being locked in a female connector, when locking screw 170' is not threaded to engage recess 174' and head 178' is projecting from aperture 187'.

First bore 182' may either be preformed with threads or thread during the initial insertion of locking 170' therein. First bore 182' is shorter in length than shaft 176' of locking screw 170' so that head 178' does not contact axially facing surface 186' when tip 180' contacts recess 174'.

Arcuate recess 174' has an inclined locking surface 188' with a first end 190' and a second end 192'. Locking surface 188' tapers downwardly towards locking screw 170' from first end 190' to second end 192'. In other words, inclined locking surface 188' tapers towards locking screw 170' in the direction of rotation to uncouple cover 14' from retainer body 16'. Preferably, inclined locking surface 188' has a slope greater than the slope of threads 46' and 112'. Thus, as cover 14' is turned counterclockwise relative to retainer body 16', the locking screw 170' will continue to contact locking surface 188' and to increase the force required to further rotate cover 14' relative to retainer body 16'. This arrangement is advantageous since inclined locking surface 188' will prevent cover 14' from inadvertently uncoupling from retainer body 16' when locking screw 170' is only partially threaded into passageway 172' and tip 180' is received in recess 174' but does not initially contact locking surface 188'.

Figure 12:
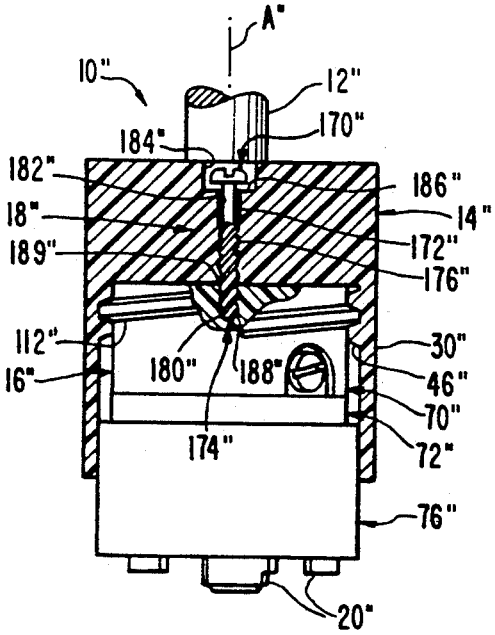
FIG. 12 is a side elevational view of a third embodiment of a male electrical connector in accordance with the present invention with certain parts broken away for clarity.

Electrical Connector of FIG. 12

Referring now to FIG. 12, a male electrical connector 10'' in accordance with a third embodiment of the present invention is illustrated, and includes a cable 12'', a cover 14'' coupled to the end of cable 12'', a retainer body 16'' threadedly and releasably coupled to cover 14'', and a locking arrangement 18'' coupled between cover 14'' and retainer body 16'' for preventing or resisting inadvertent uncoupling of cover 14'' from retainer body 16''.

Electrical connector assembly 10'' is constructed in a similar fashion to electrical connector 10 and is substantially identical to electrical connector 10, except that a modified locking arrangement 18'' has been used. Accordingly, cable 12'', cover 14'', retainer body 16'' and blade contacts 20'' are substantially identical in construction to cable 12, cover 14, retainer body 16 and blade contacts 20, and thus only the significant differences between them will be discussed and illustrated therein.

In electrical connector 10'', locking arrangement 18'' includes a locking screw or member 170'', a passageway 172'' formed in cover 14'' for threadedly receiving locking screw 170'', and cylindrical bore or recess 174'' formed in the upper surface retainer body 16'' for receiving the tip 180'' of locking screw 170''.

Locking screw 170'' extends substantially parallel to the longitudinal coupling axis A'' of electrical connector 10'', and is spaced radially from longitudinal coupling axis A''. Locking screw 170'' has a threaded shaft 176'', a head 178'' formed at one end of shaft 176'', and a round tip 180'' formed at the other end of shaft 176''.

Locking screw 170'' preferably has a fast lead type thread on shaft 176'' which will allow locking screw 170'' to seat in recess 174'' in a single revolution.

Passageway 172'' includes a first bore 182'' extending through first retainer portion 70'' for threadedly receiving thread shaft 176'' of locking screw 170'', an enlarged area or bore 184'' formed in second retainer portion 72'' for receiving head 178'' of locking screw 170'' therein, and an axially facing surface 186'' extending between bores 182'' and 184''.

First bore 182'' may either be preformed with threads or thread during the initial insertion of locking 170'' therein. First bore 182'' is shorter in length than shaft 176'' of locking screw 170'' so that head 178'' does not contact axially facing surface 186'' when tip 180'' contacts recess 174''.

Recess 174'' can be either a threaded bore as shown in FIG. 12 or unthreaded for receiving tip 180'' of locking screw 170''. Thus, recess 174'' has a pair of locking surfaces 188'' and 189''. First locking surface 188'' forms the bottom of recess 174'' and extends perpendicular to longitudinal coupling axis A''. Tip 180'' engages first locking surface 188'' to compress internal thread 46'' of cover 14'' against external thread 112'' of retainer body 16'' to create a frictional force at the thread interface between cover 14'' and retainer body 16''.

Locking surface 189'' is substantially cylindrical and extends parallel to the longitudinal coupling axis A''. Shaft 176'' of locking screw 170'' engages locking surface 189'' to prevent rotation of cover 14'' relative to retainer body 16'' even if tip 180'' of locking screw 170'' does not engage or contact locking surface 188''.

Figure 13:
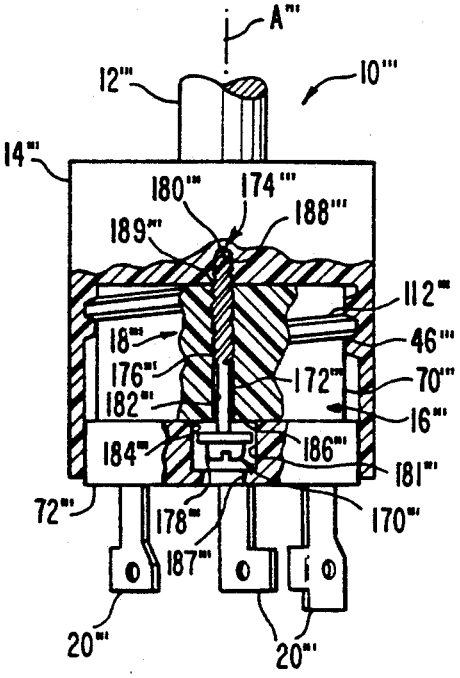
FIG. 13 is a side elevational view of a fourth embodiment of a male electrical connector in accordance with the present invention with certain parts broken away for clarity.

Electrical Connector of FIG. 13

Referring now to FIG. 13, a male electrical connector 10''' in accordance with a fourth embodiment of the present invention is illustrated, and includes a cable 12''' a cover 14''' coupled to the end of cable 12''' a retainer body 16''' threadedly and releasably coupled to cover 14''' and a locking arrangement 18''' coupled between cover 14''' and retainer body 16''' for preventing or resisting inadvertent uncoupling of cover 14''' from retainer body 16'''.

Electrical connector assembly 10''' is substantially identical to electrically connector 10' and constructed in a similar fashion to electrical connector 10', except that a modified locking arrangement 18''' has been used. Accordingly, cable 12''', cover 14''', retainer body 16''', and blade contact 20''' are substantially identical in construction to cable ', cover 14', retainer body 16' and blade contacts 20', and thus only the significant differences between them will be discussed and illustrated therein.

In electrical connector 10''', locking arrangement 18''' includes a locking screw or member 170''', a passageway 172''' formed in retainer body 16''' for threadedly receiving locking screw 170''', and a cylindrical bore or recess 174''' formed in the inside end wall of cover 14''' for receiving the tip 180''' of locking screw 170'''.

Locking screw 170''' extends substantially parallel to the longitudinal coupling axis A''' of electrical connector 10''', and is spaced radially from longitudinal coupling axis A'''. Locking screw 170''' has a threaded shaft 176''', a head 178''' formed at one end of shaft 176''', and a round tip 180''' formed at the other end of shaft 176'''.

Locking screw 170''' preferably has a fast lead type thread on shaft 176''' which will allow locking screw 170''' to seat in recess 174''' in a single revolution. Head 178''' has an annular shoulder 181''' extending outwardly therefrom and located adjacent shaft 176'''.

Passageway 172''' includes a first bore 182''' extending through first retainer portion 70''' for threadedly receiving thread shaft 176''' of locking screw 170''' an enlarged area or bore 184''' formed in second retainer portion 72''' for receiving head 178''' of locking screw 170''' therein, an axially facing surface 186''' extending between bores 182''' and 184''', and an exit aperture or bore 187''' formed in second retainer portion 72'''. Enlarged area or bore 184''' is slightly larger than the diameter of shoulder 181''' of head 178''', while exit aperture or bore 187''' is smaller than the diameter of shoulder 181''' but larger than the diameter of the rest of head 178'''. Thus, this arrangement prevents connector 10''' from being locked in a female connector, when locking screw 170''' is not threaded to engage recess 174''' and head 178''' is projecting from aperture 187'''.

First bore 182''' may either be preformed with threads or thread during the initial insertion of locking 170''' therein. First bore 182''' is shorter in length than shaft 176''' of locking screw 170''' so that head 178''' does not contact axially facing surface 186''' when tip 180''' contacts recess 174'''.

Recess 174'' can be either a threaded bore as shown in FIG. 13 or unthreaded for receiving tip 180''' of locking screws 170'''. Thus, recess has a pair of locking surfaces 188''' and 189'''. First locking surface 188''' forms the bottom of recess 174''' and extends perpendicular to longitudinal coupling axis A'''. Tip 180''' of locking screw 170''' engages first locking surface 188''' of compress internal thread 46''' of cover 14''' against external thread 112''' of retainer body 16''' to create a frictional force at the thread interface between cover 14''' and retainer body 6'''.

Second locking surface 189''' is substantially cylindrical and extends substantially parallel to longitudinal coupling axis A'''. Shaft 176''' of locking screw 170''' engages locking surface 189''' to prevent rotation of cover 14''' relative to retainer body 16''' even if tip 180''' of locking screw 170''' does not engage or contact first locking surface 188'''.

While advantageous embodiments have been chosen to illustrate the invention, it will be understood by those skilled in the art that various changes and modifications can be made herein without departing from the scope of the invention as defined in the appended claims.

What is claimed is:

1. An electrical connector, the combination comprising:

a retainer body having first and second oppositely facing ends with a longitudinal coupling axis extending therebetween, at least two curved blade contacts extending axially from said first end, and an external thread thereon;

a cover having first and second ends with a longitudinal coupling axis extending therebetween, an aperture adapted to receive an electrical cable therethrough for electrical connection to said curved blade contacts, and a longitudinally extending bore with an internal thread thereon threadedly engaged with said external thread on said retainer body via rotation of said cover relative to said retainer body in a first direction;

a passageway located in one of said cover and retainer body and having internal threads thereon; and locking means, coupled to one of said retainer body and said cover and extending longitudinally between said second end of said retainer and said cover, for resisting rotation of said cover relative to said retainer body in a second direction opposite said first direction, said locking means comprising a locking member coupled to one of said cover and retainer body and having external threads threadedly engaged with said internal threads on said passageway, and a locking surface coupled to the other of said cover and retainer body and engaged with said locking member.

2. An electrical connector according to claim 1, wherein said passageway has an enlarged area and an exit aperture smaller than and adjacent said enlarged area, and said locking member has a shoulder slidably receivable in said enlarged area and a head slidably receivable in said enlarged area and said exit aperture, said shoulder being wider than said head and wider than said exit aperture.

3. An electrical connector according to claim 1, wherein said locking surface is substantially flat.

4. An electrical connector according to claim 1, wherein said locking surface is substantially cylindrical.

5. An electrical connector according to claim 4, wherein said cylindrical locking surface has internal threads threadedly engageable with said external threads of said locking member.

6. An electrical connector according to claim 1, wherein said locking surface is inclined to said longitudinal coupling axes.

7. An electrical connector according to claim 1, wherein said inclined surface tapers towards said locking member from a first end to a second end in said second direction.

8. An electrical connector according to claim 1, wherein said longitudinal coupling axes of said retainer body and said cover have a common longitudinal axis, and said locking member extends substantially parallel to and spaced from said common longitudinal axis.

9. An electrical connector according to claim 8, wherein said locking surface extends substantially perpendicular to said common longitudinal axis.

10. An electrical connector according to claim 8, wherein said locking surface extends substantially parallel to said longitudinal axis.

11. An electrical connector coupling assembly, the combination comprising:

a male member having a substantially cylindrical side surface with a longitudinal coupling axis, an external coupling member coupled to said side surface, and a free end with an end surface extending transverse to said longitudinal coupling axis;

a female member having a substantially cylindrical internal surface forming a bore with a longitudinal coupling axis for receiving said free end of said male member therein, and an internal coupling member coupled to said internal surface and fixedly engaged with said external coupling member on said male member via rotation of said female member relative to said male member in a first direction;

a passageway located in one of said male and female members and having internal threads thereon; and locking means, coupled to one of said male and female members and extending longitudinally between said male and female members, for resisting rotation of said female member relative to said male member in a second direction opposite said first direction and for preventing inadvertent uncoupling of said female member from said male member by rotation in said second direction.

said locking means comprising a locking member coupled to one of said male and female members and having external threads threadedly engaged with said internal threads on said passageway, and a locking surface coupled to the other of said male and female members and engaged with said locking member.

12. A coupling assembly according to claim 11, wherein said passageway has an enlarged area and an exit aperture smaller than and adjacent said enlarged area, and said locking member has a shoulder slidably receivable in said enlarged area and a head slidably receivable in said enlarged area and said exit aperture, said shoulder being wider than said head and wider than said exit aperture.

13. A coupling assembly according to claim 11, wherein said locking surface is substantially flat.

14. A coupling assembly according to claim 11, wherein said locking surface is substantially cylindrical.

15. A coupling assembly according to claim 14, wherein said cylindrical locking surface has internal threads threadedly engageable with said external threads of said locking member.

16. A coupling assembly according to claim 11, wherein said locking surface is inclined to said longitudinal coupling axes.

17. A coupling assembly according to claim 16, wherein said inclined surface tapers towards said locking member from a first end to a second end in said second direction.

18. A coupling assembly according to claim 11, wherein said longitudinal coupling axes of said male and female members have a common longitudinal axis, and said locking member extends substantially parallel to and spaced from said common longitudinal axis.

19. A coupling assembly according to claim 18, wherein said locking surface extends substantially perpendicular to said common longitudinal axis.

20. A coupling assembly according to claim 18, wherein said locking surface extends substantially parallel to said longitudinal axis.

21. A coupling assembly according to claim 18, wherein said locking surface extends at a substantially acute angle relative to said common longitudinal axis.

22. A coupling assembly according to claim 11, wherein said coupling members are threads for releasably coupling said male and female members together.

23. A coupling assembly according to claim 22, wherein said male member is an electrical retainer body having electrical contacts and said female member is a nonconductive cover.

24. An electrical connector coupling assembly, the combination comprising:

a male member having a substantially cylindrical side surface with a longitudinal coupling axis, an external coupling member coupled to said side surface, and a free end with an end surface extending transverse to said longitudinal coupling axis;

a female member having a substantially cylindrical internal surface forming a bore for receiving said free end of said male member therein, and an internal coupling member coupled to said internal surface and fixedly engaged with said external coupling member on said male member via rotation of said female member relative to said male member in a first direction; and locking means, coupled to one of said male and female members and extending longitudinally between said male and female members, for resisting rotation of said female member relative to said male member in a second direction opposite said first direction and for preventing inadvertent uncoupling of said female member from said male member by rotation of said female member in said second direction, said locking means including a locking screw coupled to one of said male and female members for engaging said male and female members to apply a sufficiently strong axially extending force on said internal and external coupling members to axially compress said internal and external coupling members into engagement, and for increasing the frictional forces therebetween to resist rotation of said female member relative to said male member.

25. A coupling assembly according to claim 24, wherein said locking means further includes a locking surface coupled to the other of said male and female members and engaged with said locking screw.

26. An electrical connector according to claim 25, wherein said locking surface extends substantially perpendicular to said longitudinal axis.

27. An electrical connector according to claim 25, wherein said locking surface extends substantially parallel to said longitudinal axis.

28. An electrical connector according to claim 25, wherein said locking surface extends at a substantially acute angle relative to said longitudinal axis.

29. An electrical connector, the combination comprising:

a retainer body having first and second oppositely facing ends with a longitudinal coupling axis extending therebetween, at least two curved blade contacts extending axially from said first end, and an external thread thereon;

a cover having first and second ends with said longitudinal coupling axis extending therebetween, an aperture adapted to receive an electrical cable therethrough for electrical connection to said curved blade contacts, and a longitudinally extending bore with an internal thread thereon threadedly engaged with said external thread on said retainer body via rotation of said cover relative to said retainer body in a first direction which couples said cover to said retainer body; and locking means, coupled to said retainer body and said cover and extending longitudinally between said second end of said retainer and said cover, said locking means comprising a locking member coupled to one of said cover and retainer body, and a locking surface coupled to the other of said cover and retainer body and engaged with said locking member upon rotation of said cover relative to said retainer body in a second direction opposite said first direction for resisting rotation in said second direction and preventing inadvertent uncoupling of said cover and said retainer body, said locking surface extending at a substantially acute angle relative to said longitudinal axis and inclined towards said locking member in said second direction.

said locking member being a screw for preventing axial movement thereof by relative rotation between said retainer body and said cover to prevent uncoupling from occurring.

30. An electrical connector according to claim 29, wherein said locking surface has a first slope and said external threads on said retainer body and said internal threads in said cover have a second slope, said first slope being greater than said second slope.

* * * * *